US005702648A

United States Patent [19]

White et al.

[11] Patent Number: 5,702,648

[45] Date of Patent: Dec. 30, 1997

[54] SELF-CONTAINED ROOM AIR HUMIDIFIER

[75] Inventors: Kenneth P. White, Burlington, N.C.; David B. White, Lewisberry, Pa.

[73] Assignee: Morgan & White Ltd., PA Corp., Lewisberry

[21] Appl. No.: 602,582

[22] Filed: Feb. 16, 1996

[51] Int. Cl.[6] ..... B01F 3/04

[52] U.S. Cl. ..... 261/142; 261/30; 261/81; 261/DIG. 15; 261/DIG. 48

[58] Field of Search ..... 261/30, DIG. 15, 261/DIG. 18, 142, 81

[56] References Cited

U.S. PATENT DOCUMENTS

| | | | |
|---|---|---|---|
| 1,821,297 | 9/1931 | Driscoll | 261/30 |
| 1,835,760 | 12/1931 | Cornelius | 261/91 |
| 2,035,628 | 3/1936 | Whitmer et al. | 261/DIG. 15 |
| 2,066,688 | 1/1937 | Keilholtz | 261/30 |
| 2,164,718 | 7/1939 | Norman | 261/30 |
| 2,173,073 | 9/1939 | Pierson | 261/30 |
| 2,824,621 | 2/1958 | Carrier . | |
| 3,105,860 | 10/1963 | Dunn . | |
| 3,325,976 | 6/1967 | West . | |
| 3,561,194 | 2/1971 | Baldwin et al. . | |
| 3,804,388 | 4/1974 | Jamell | 261/DIG. 15 |
| 3,990,427 | 11/1976 | Clinebell . | |
| 4,003,967 | 1/1977 | Potvin | 261/142 |
| 4,031,171 | 6/1977 | Asao et al. . | |
| 4,257,989 | 3/1981 | Nishikawa . | |
| 4,410,139 | 10/1983 | Nishikawa et al. . | |
| 4,731,204 | 3/1988 | Noma et al. | 261/DIG. 48 |
| 4,752,422 | 6/1988 | Uchida et al. . | |
| 5,407,604 | 4/1995 | Luffman . | |
| 5,413,765 | 5/1995 | Smith et al. . | |
| 5,464,572 | 11/1995 | Bonzi . | |

*Primary Examiner*—Tim R. Miles
*Attorney, Agent, or Firm*—Quarles & Brady

[57] ABSTRACT

A mist generating, self-contained room air humidifier ensures substantially complete evaporation of the mist introduced to an air flow drawn from a room environment prior to discharge back into the room by preferably providing a vertical column extending upwardly from the mist generator to the humidifier outlet and having sufficient height to allow complete evaporation.

9 Claims, 3 Drawing Sheets

SELF-CONTAINED ROOM AIR HUMIDIFIER

FIELD OF THE INVENTION

The invention relates to self-contained room air humidifiers. More particularly, the invention relates to mist generating room air humidifiers.

BACKGROUND OF THE INVENTION

Self-contained room air humidifiers are used to introduce water, and other additives, to air in an enclosed environment, such as a room. Mist generators or mist sources, such as steam boilers, atomizers, nebulizers and ultrasonic vibrators, have been used to present water in the form of droplets to a passing flow of air.

Self-contained room air humidifiers are typically constructed in compact housings. Also, self-contained room air humidifiers in the past have injected the mist of water particles into the room environment for subsequent evaporation. Many droplets produced by a mist generator and introduced to the room environment to be humidified do not completely evaporate before contacting and wetting furniture, computers or other valuable equipment. Yet, despite the disadvantages of mist collection, self-contained room air humidifiers continue to project unevaporated water into the environment, perhaps due in part to the limitations of their small, compact size.

SUMMARY OF THE INVENTION

It is an object of the invention to provide a self-contained room air humidifier that prevents damage to furniture, equipment and the like in a humidified room.

It is a further object of the invention to provide a self-contained room air humidifier that is constructed to minimize required floor space for the self-contained room air humidifier.

It yet another object of the invention to provide a self-contained room air humidifier that can be positioned in a variety of room locations including against a wall to avoid obstruction to intended room activity without exposing the wall or other room structure to moisture damage.

It is still another object of the invention to provide variable levels of humidification without exposing furniture, equipment and the like to moisture damage.

These and other objects of the invention are achieved by preferred embodiments of a self-contained room air humidifier that receives air from the primary room environment and completely evaporates an introduced mist before discharge of the humidified air back into the primary room environment.

The self-contained room air humidifier includes a housing having an inlet for receiving air from the primary room environment and an outlet for discharging humidified air back into the primary room environment. A mist generator, including a water reservoir, is disposed in said housing for producing a mist to humidify air received through the inlet from the primary room environment. A fan moves air past the mist generator.

According to a preferred aspect of the invention, the housing of the self-contained room air humidifier encloses an evaporation chamber or column extending vertically from the mist generator to the outlet for transport of the air and mist. The evaporation column has predetermined specifications such that the mist is completely evaporated in the air prior to discharge back into the primary room environment.

These predetermined specifications are governed by such factors as the level of humidity required and typically result in an elongated chamber or column. However, the vertical orientation of the preferred column embodiment provides this needed length without taking up floor space, which can be critical in a laboratory or other commercial environment.

The desired evaporation chamber specifications can also be arranged in a horizontal configuration. Embodiments can include a horizontally elongated chamber or a chamber that extends in a zigzag manner. These embodiments present a variety of room positioning alternatives to meet the space use requirements of the users of the humidified room.

To further avoid obstruction of important commercial space, the inlet and the outlet can preferably be arranged on the same side of the housing so that the opposite side of the housing can be placed against a wall of the room. This positioning minimizes obstruction to room activity while allowing the air flow to freely cycle through the self-contained room air humidifier without impacting the wall with moisture. This wall mounting orientation is preferably combined with the space saving advantages of the vertical evaporation column but can also be utilized with the horizontal embodiments as well.

Thus, the invention provides discharged, humidified air that is free of water particles that can damage furniture in a residential environment or valuable equipment, such as computers, in a commercial area. This fully evaporated humidified air is preferably provided with minimized occupation of floor space and obstruction of room activity.

BRIEF DESCRIPTION OF THE DRAWINGS

A more thorough understanding of embodiments of the invention can be gained from a reading of the following detailed description together with the accompanying drawings, in which.

DETAILED DESCRIPTION OF PREFERRED EMBODIMENTS

The invention is directed to a room air humidification system that provides complete evaporation of the water solution within the system prior to introduction to the primary room environment. The preferred embodiments of the invention discussed in this specification are arranged to minimize obstruction to room activity in the humidified room and to minimize occupied floor space.

As used throughout this specification and the claims, primary room environment refers to the air space to which the water vapor is to be added to increase the relative humidity of the air. This primary room environment can include an enclosed room of a residential dwelling and an office, lab or manufacturing area.

The self-contained room air humidification system is intended for use primarily with water but also contemplates that the water may include additives, such as fragrances, deodorants, aerosols or other additives. Preferably, the water is de-ionized and otherwise purified.

Figure 1:
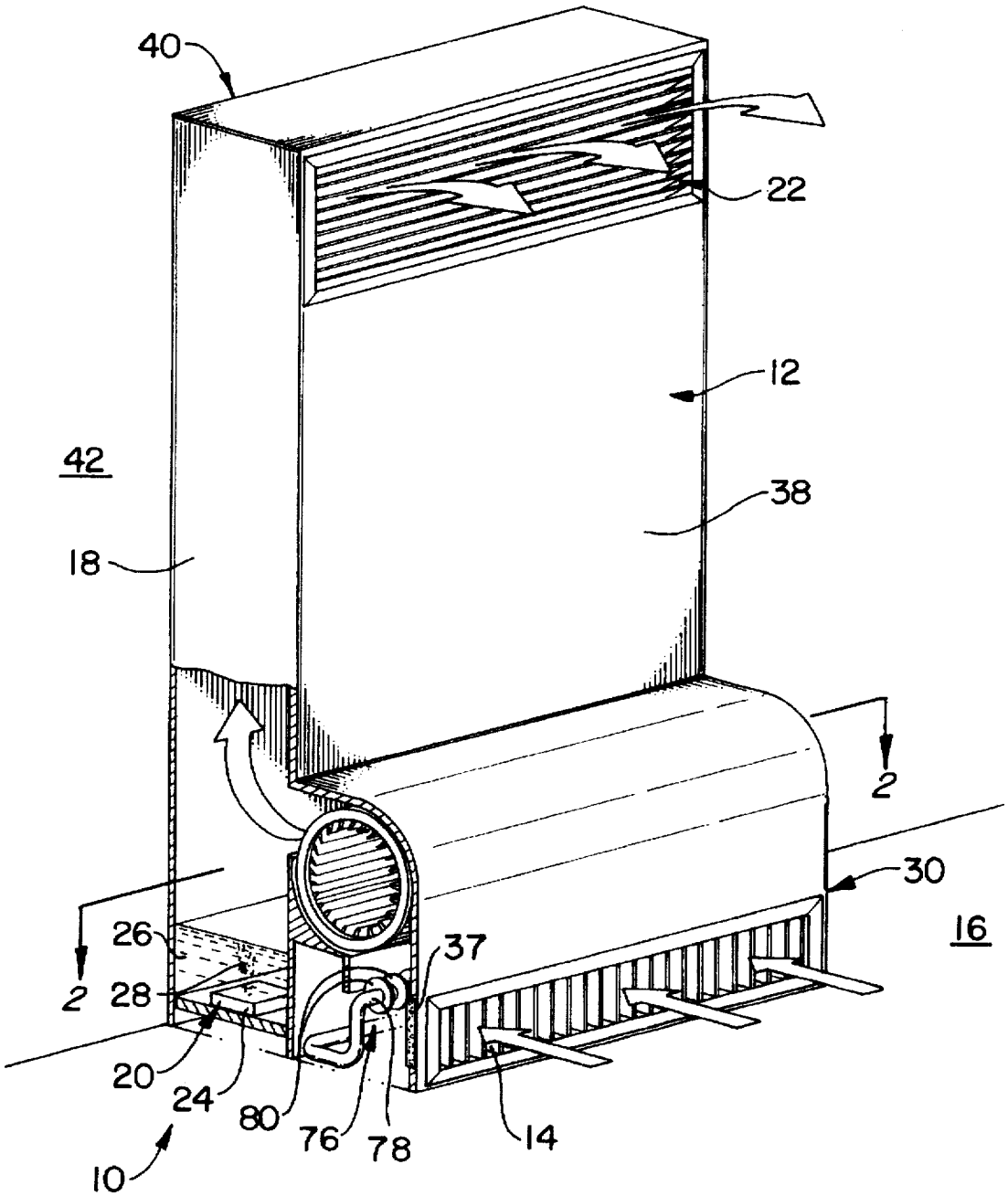
FIG. 1 is a perspective view of a preferred embodiment of a self-contained room air humidifier according to the invention, with a partial breakaway to reveal its internal features.
Figure 2:
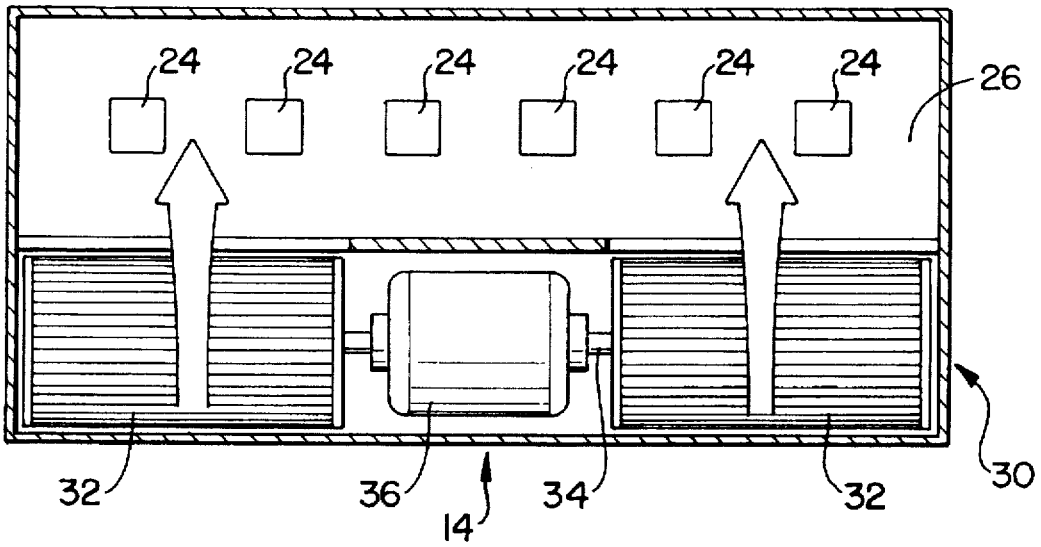
FIG. 2 is a sectional view along line 2—2 in FIG. 1.

Referring to the figures and particularly to FIGS. 1 and 2, a preferred self-contained room air humidifier 10 includes a housing 12 having an inlet 14 for receiving air from a primary room environment 16 and drawing the air flow through an evaporation chamber, such as a vertical evaporation column 18 for complete evaporation of water added by a mist generator 20 before discharge through an outlet 22 back into the primary room environment 16.

The mist source 20 is provided within the housing 12. The self-contained room air humidifier 10 can include any of a variety of mist generators or mist sources. While the preferred embodiment disclosed utilizes one or more high frequency, ultrasonic transducers 24 (FIG. 2) for cavitating water in a reservoir 26 into upwardly directed water fingers 28, the self-contained room air humidifier 10 can use other mist generators, including atomizers, nebulizers, vibrators and steam generating heaters. Generally, the mist generator 20 can be any device or system that presents a mist of liquid for pick up by a passing air flow. The water reservoir 26 can be supplied by a variety of sources (not shown), such as a remote filtered water storage tank or a tap water supply directed through a water filtration system. Alternatively, a water filtration system can be included within the self-contained room air humidifier. Water levels in the reservoir 26 can be maintained in known manner, for example, by a floater-activated solenoid valve or other level control systems (not shown).

Individual mist generators capable of producing the mist rate required for the particular system can be employed, or the mist rate can be achieved by using a plurality of mist generators. The level of humidification can be adjusted by known techniques, such as microprocessor-controlled pulsation of power to the transducers.

The air flow is preferably driven by a fan 30. The fan 30 can be located external of the housing 12 and blow air into an inlet. Alternatively, the fan 30 can be integrated into the housing 12 and provide the inlet 14 for the system 10. The fan 30 is preferably a cross-flow type. As shown in FIG. 2, the fan 30 can include two coaxial fan portions 32 mounted on a shaft 34 powered by an electric motor 36 positioned between the fan portions 32. Alternative fans types, such as squirrel cage fans, can also be used. The inlet 14 to the fan 30 can be covered by a replaceable air filter 37 (FIG. 1).

The outlet 22 is preferably arranged to discharge horizontally after a curved transition from the vertical column 18. The inlet 14, outlet 22 and vertical column 18 cross sections can be arranged in a variety of geometries, provided a vertical passage is maintained between the mist source 20 and the outlet 22 to allow for evaporation of the mist prior to discharge.

The inlet 14 and the outlet 22 are preferably positioned on the same side 38 of the housing 12. In this way, the opposing side 40 of the housing 12 can be arranged adjacent a wall 42 of the room 16 without interfering with air flow to and from the self-contained room air humidifier 10. The positioning of the inlet 14 and the outlet 22 enables the housing 12 to be placed flush against the wall 42 away from the activity of the room 16, and provides alternative opportunities for placement of the self-contained room air humidifier 10 within the room 16 to meet the particular space needs of the users of the room 16.

During construction of a room and its walls, the preferred self-contained room air humidifier 10 could by incorporated into the wall, such as between the supporting studs of the wall structure.

The housing 12 is preferably constructed of ABS plastic. Alternatively, the housing 12 can be constructed of stainless steel of a sturdy structural material having a coated surface to avoid corrosion from the mist source 20.

Figure 3:
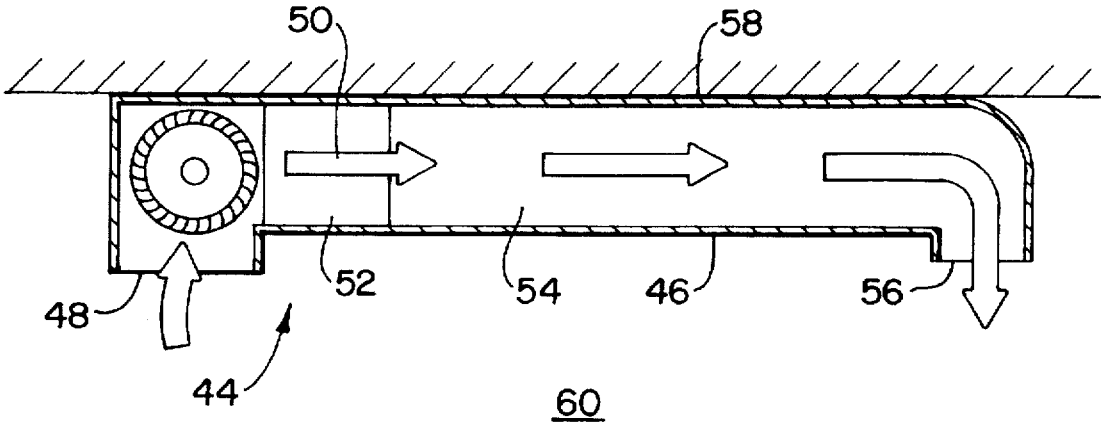
FIG. 3 is a schematic top plan illustration of a horizontal embodiment of the invention.

Many of the advantages of the invention can be enjoyed in alternative configurations in which the evaporation chamber is horizontally arranged. Referring to FIG. 3, an alternative self-contained room air humidifier 44 can include a housing 46 having an inlet 48 for introducing air 50 past a mist generator 52 and into an evaporation chamber 54. The evaporation chamber 54 extends to an outlet 56 and is dimensioned, particularly with sufficient length, to ensure complete evaporation prior to discharge of the humidified air. The housing 46 can be primarily arranged horizontally and against a wall 58 for applications in which vertical wall space is needed in the use of the room 60.

Figure 4:
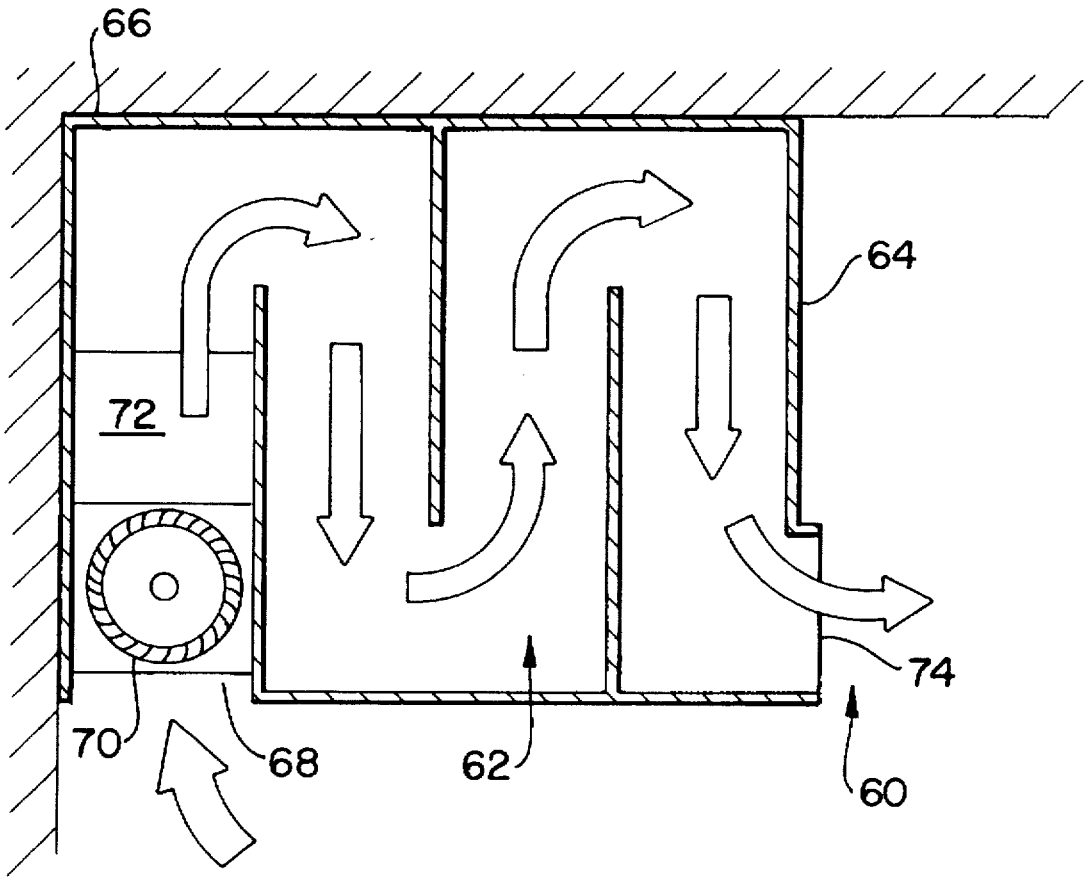
FIG. 4 is a schematic top plan illustration of an alternative horizontal embodiment of the invention.

As illustrated in FIG. 4, another alternative self-contained room air humidifier 60 can include an evaporation chamber 62 providing a zigzag path to provide the desired length for complete internal evaporation in a reduced sized housing 64. This arrangement can have application in which placement in a corner 66 is desired for the room space needs. This embodiment can include an inlet 68, a fan 70, a mist generator 72 and an outlet 74. The horizontal embodiments of FIGS. 3 and 4 are illustrated in schematic fashion to show preferred spatial arrangements of the elements of the invention. The construction of the fan 70, mist source 72 and housing 64 can be performed similarly to the vertical column embodiment 10 shown in FIGS. 1 and 2.

According to the invention, the internal evaporation is accomplished by coordinating a plurality of factors, including the air volume rate with the moisture production rate of the mist generators used. To ensure complete evaporation of the water solution into the air flow within the self-contained room air humidifier, the evaporation chamber is constructed to accommodate a predetermined minimum air volume at a predetermined maximum air speed for the desired quantity of water solution to be added per unit time. The evaporation chamber is preferably dimensioned in accordance with a minimum air volume to absorb the water added by the mist source. The minimum air volume can be calculated by the following formula:

$$CFM = \frac{BTU/hr}{1.1\Delta T},$$

where CFM is the minimum air volume expressed in cubic feet per minute;

BTU/hr represents that heat absorbed from the air flow by the introduced water due to the evaporation process. This parameter is specified or readily determinable from the mist quantity rate for a mist generator, such as an ultrasonic transducer.

$\Delta T$ refers to the temperature drop in the air flow due to the evaporative process. The permitted temperature differential to avoid saturation can be obtained from a psychrometric chart.

Once air volume for the desired water quantity per unit time is calculated, the evaporation chamber is preferably constructed with a cross sectional area so that the air velocity in the evaporation chamber does not exceed 750 feet per minute, as this rate or slower has been found to provide adequate opportunity for complete evaporation before discharge.

The specifications of an exemplary embodiment of the invention can illustrate the application of the factors for ensuring complete internal evaporation. In a self-contained room air humidifier utilizing a vertical evaporation chamber and an transducers producing 5 lb. $H_2O$/hr., an air volume rate of 300 cfm is preferred. Under these parameters, a vertical column having cross-sectional dimensions of 20 inches by 3.5 inches is preferably 7 feet from the top of the reservoir to the outlet to ensure complete evaporation of the mist before discharge. These parameters are considered as examples not intended to limit the scope of the invention as other combinations will now be apparent to one skilled in the art.

In certain room environments, larger relative humidity on the order of 70% relative humidity is desired. Such applications include, for example, cigar humidors. To provide these humidity levels, the temperature of the air flow through the self-contained room air humidifier can be increased to provide a greater temperature differential during the evaporation process. In environments in which the ambient temperature is not sufficiently high to allow the relatively high humidification, the self-contained room air humidifier can include a preheater, such as a electric radiant heater 76 (FIG. 1). The heater 76 can include a bar 78 with fins 80 and extend across the channel of the fan 30, upstream of the mist generator 20. Alternative heating constructions can also be used provided the air flow is heated to a sufficient temperature before introduction to the evaporation chamber.

The preheater also provides for more effective evaporation due to the higher temperature air flow, even in situations in which high relative humidity is not required. Thus, a preheater can increase the permissible AT and thereby decrease the necessary CFM, resulting in reduced fan and housing size requirements.

In view of the preferred embodiments described, alternative constructions incorporating the features of the invention will now be clear to one skilled in the art. Thus, although preferred embodiments of the invention have been discussed with particular detail, it is intended that the scope of the invention not be limited by this disclosure but rather by a reasonable construction of the following claims.

We claim:

1. A self-contained room air humidifier for completely evaporating a water mist in air drawn from a primary room environment prior to discharge back into the primary room environment, said self-contained room air humidifier comprising:

a housing having an inlet for receiving air from the primary room environment and an outlet for discharging humidified air back into the primary room environment;

a mist generator including a water reservoir, said mist generator being disposed in said housing for producing a mist to humidify air received through the inlet from the primary room environment; and a fan for moving air past the mist generator;

said housing enclosing an evaporation chamber extending from the mist generator to the outlet for transport of the air and mist, said evaporation chamber being dimensioned such that the mist is completely evaporated in the air prior to discharge back into the primary room environment, wherein the evaporation chamber is elongated and at least seven feet long.

2. The self-contained room air humidifier according to claim 1, wherein the evaporation chamber extends in a zigzag manner.

3. The self-contained room air humidifier according to claim 1, wherein the fan is enclosed within the housing and draws air through the inlet.

4. The self-contained room air humidifier according to claim 2, wherein the fan draws at least an air volume CFM according to the formula $$CFM = \frac{BTU/hr}{1.1\Delta T},$$

where CFM is the minimum air volume expressed in cubic feet per minute; BTU/hr represents that heat absorbed from the air flow by the introduced water due to the evaporation process; and ΔT refers to the maximum temperature drop in the air flow due to the evaporative process to avoid saturation.

5. The self-contained room air humidifier according to claim 1, further comprising a preheater for raising the temperature of air introduced through the inlet prior to passing the mist generator.

6. The self-contained room air humidifier according to claim 1, wherein the vertical dimension of the elongated evaporation chamber is longest.

7. The self-contained room air humidifier according to claim 6, wherein the inlet and the outlet are positioned on the same side of the housing.

8. The self-contained room air humidifier according to claim 1, wherein the horizontal dimension of the elongated evaporation chamber is longest.

9. The self-contained room air humidifier according to claim 8, wherein the inlet and the outlet are positioned on the same side of the housing.

* * * * *